US010599082B2

(12) United States Patent
Kemmochi et al.

(10) Patent No.: US 10,599,082 B2
(45) Date of Patent: Mar. 24, 2020

(54) IMAGE FORMING APPARATUS AND PATTERN DETECTION METHOD BY IMAGE FORMING APPARATUS

(71) Applicants: Takuya Kemmochi, Kanagawa (JP); Natsuko Ishizuka, Kanagawa (JP); Kazushi Takei, Kanagawa (JP); Junichi Shimoda, Tokyo (JP); Naohiro Funada, Kanagawa (JP)

(72) Inventors: Takuya Kemmochi, Kanagawa (JP); Natsuko Ishizuka, Kanagawa (JP); Kazushi Takei, Kanagawa (JP); Junichi Shimoda, Tokyo (JP); Naohiro Funada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/298,350

(22) Filed: Mar. 11, 2019

(65) Prior Publication Data

US 2019/0286035 A1 Sep. 19, 2019

(30) Foreign Application Priority Data

Mar. 19, 2018 (JP) ..... 2018-051795

(51) Int. Cl.
*G03G 15/00* (2006.01)
*G03G 15/01* (2006.01)
*G03G 15/08* (2006.01)

(52) U.S. Cl.
CPC ..... *G03G 15/5062* (2013.01); *G03G 15/0121* (2013.01); *G03G 15/0822* (2013.01); *G03G 15/5058* (2013.01)

(58) Field of Classification Search
CPC ..... G03G 15/5041; G03G 15/5054; G03G 15/5058; G03G 15/5062
See application file for complete search history.

(56) References Cited

U.S. PATENT DOCUMENTS

2011/0211231 A1* 9/2011 Murayama ..... H04N 1/409 358/3.27
2011/0318065 A1 12/2011 Shimoda
(Continued)

FOREIGN PATENT DOCUMENTS

| | | |
|---|---|---|
| JP | 2003-207973 | 7/2003 |
| JP | 2009-047719 | 3/2009 |
| JP | 2011-059637 | 3/2011 |

OTHER PUBLICATIONS

Machine Translation of JP2003-207973. Jul. 25, 2003. (Year: 2003).*

*Primary Examiner* — Carla J Therrien
(74) *Attorney, Agent, or Firm* — Duft & Bornsen, PC

(57) ABSTRACT

An image forming apparatus includes an image bearer, an image forming unit, a toner image detecting unit, and a detection processing unit. The image bearer is configured to bear a toner image. The image forming unit is configured to sequentially form groups of pattern images for a plurality of colors in a sub-scanning direction of the image bearer, each of the groups including pattern images of the same color at a predetermined interval. The toner image detecting unit is configured to detect the pattern images formed on the image bearer. The detection processing unit is configured to recognize whether an interval between adjacent pattern images of the same color corresponds to a set interval, to exclude an image for which the interval does not correspond to the set interval among the detected pattern images.

6 Claims, 7 Drawing Sheets

(56) References Cited

U.S. PATENT DOCUMENTS

2014/0064800 A1* 3/2014 Sato ..... G03G 15/0189
399/301
2017/0351206 A1* 12/2017 Hamano ..... G03G 15/043

* cited by examiner

IMAGE FORMING APPARATUS AND PATTERN DETECTION METHOD BY IMAGE FORMING APPARATUS

CROSS-REFERENCE TO RELATED APPLICATIONS

The present application claims priority under 35 U.S.C. § 119 to Japanese Patent Application No. 2018-051795, filed on Mar. 19, 2018. The contents of which are incorporated herein by reference in their entirety.

BACKGROUND OF THE INVENTION

1. Field of the Invention

The present invention relates to an image forming apparatus and a pattern detection method implemented by the image forming apparatus.

2. Description of the Related Art

Conventionally, an image forming apparatus that handles full-color images generates an image by superimposing toner images of a plurality of colors, in general, four colors of yellow (Y), magenta (M), cyan (C), and black (K), and shift caused by superimposition is an issue that needs to be addressed. To deal with this issue, a technique for forming an image of an adjustment toner pattern for each of the colors on an image bearer (transfer belt) and detecting the patterns using a sensor to thereby detect and correct color shift has been known.

For example, Japanese Unexamined Patent Application Publication No. 2003-207973 discloses a technique for preparing pattern sets, each including a single pattern for each of the four colors of Y, M, C, and K, and regarding patterns that do not have an expected distance relationship among detected patterns as defects by using distances between the Y patterns, distances between the M patterns, distances between the C patterns, and distances between the K patterns among the pattern sets.

However, in color shift correction control as described above, if there is a defect on a belt (image bearer) and a sensor detects the defect similarly to the toner patterns, it is difficult to distinguish the defect from the toner patterns, and in some cases, it is difficult to accurately detect color shift as originally expected.

SUMMARY OF THE INVENTION

According to one aspect of the present invention, an image forming apparatus includes an image bearer, an image forming unit, a toner image detecting unit, and a detection processing unit. The image bearer is configured to bear a toner image. The image forming unit is configured to sequentially form groups of pattern images for a plurality of colors in a sub-scanning direction of the image bearer, each of the groups including pattern images of the same color at a predetermined interval. The toner image detecting unit is configured to detect the pattern images formed on the image bearer. The detection processing unit is configured to recognize whether an interval between adjacent pattern images of the same color corresponds to a set interval, to exclude an image for which the interval does not correspond to the set interval among the detected pattern images.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
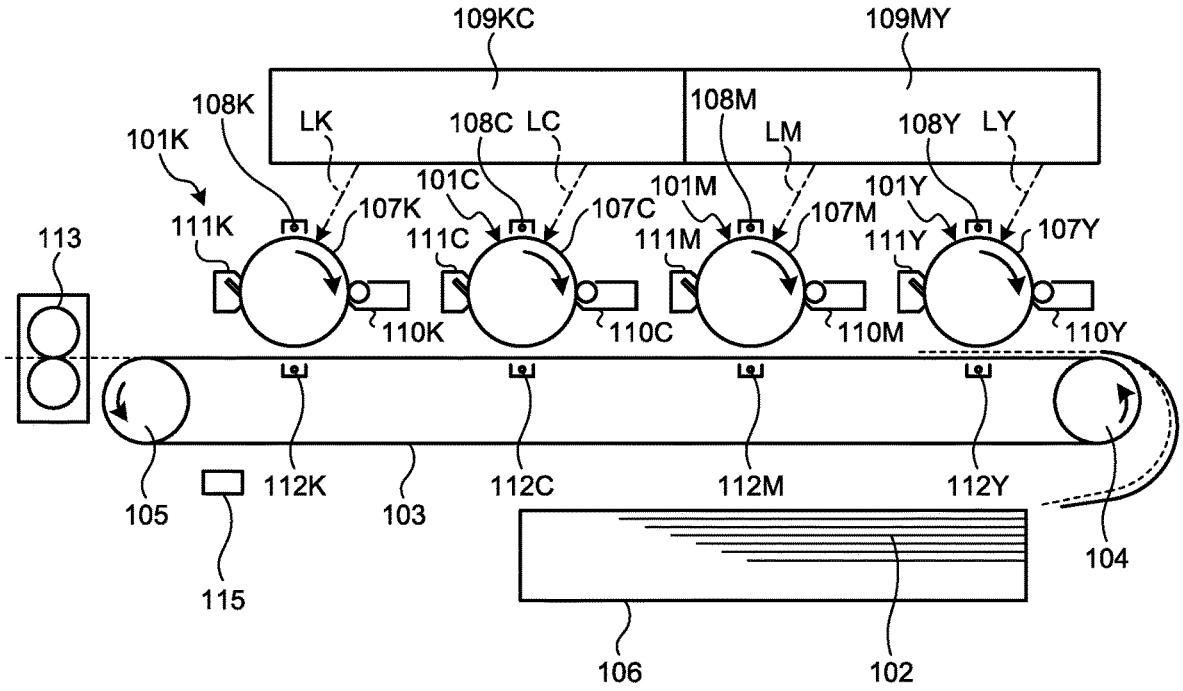
FIG. 1 is a diagram for explaining a configuration of main parts of a color copier that is an image forming apparatus.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment has an object to improve accuracy of detection of a color shift correction toner pattern that is formed on an image bearer.

Exemplary embodiments of an image forming apparatus and a pattern detection method implemented by the image forming apparatus according to the present invention will be described in detail below with reference to the accompanying drawings.

Embodiment

First, the principle of image formation by a color copier will be described with reference to FIG. 1. FIG. 1 is a diagram for explaining a configuration of main parts of a color copier that is an image forming apparatus. In particular, FIG. 1 illustrates image processing units, an exposing unit, and a transfer belt for explaining the principle of image formation. The color copier illustrated in FIG. 1 has a tandem configuration and forms an image on a recording paper by performing image formation in accordance with an electrophotographic system.

The color copier is a tandem type, in which four image forming units 101Y, 101M, 101C, and 101K included in the image processing units that form images of different colors (yellow (Y), magenta (M), cyan (C), and black (K)) are arranged in line along a transfer belt 103 that is an image bearer for transferring a sheet of recording paper 102 that is a transfer medium. The transfer belt 103 is stretched between a driving roller 104 that rotates and a driven roller 105 that is driven to rotate, and rotates in a direction of an arrow in FIG. 1 along with the rotation of the driving roller 104. A paper feeding tray 106 housing the recording paper 102 is provided below the transfer belt 103. A topmost sheet of the recording paper 102 housed in the sheet feed tray 106 is fed toward the transfer belt 103 at the time of image formation, and adsorbed to the transfer belt 103 due to electrostatic adsorption. The adsorbed recording paper 102 is conveyed to the image forming unit 101Y, and an image of Y color is first formed at this position.

The image forming units 101Y, 101M, 101C, and 101K include photoconductor drums 107Y, 107M, 107C, and 107K, charging units 108Y, 108M, 108C, and 108K arranged around the photoconductor drums 107Y, 107M, 107C, and 107K, developing devices 110Y, 110M, 110C, and 110K, photoreceptor cleaners 111Y, 111M, 111C, and 111K, and transfer devices 112Y, 112M, 112C, and 112K, respectively.

The surface of the photoconductor drum 107Y of the image forming unit 101Y is uniformly charged by a charging unit 8Y and exposed with a laser beam LY corresponding to the image of Y color by an exposing unit 109MY, so that an electrostatic latent image is formed. The formed electrostatic latent image is developed by the developing device 110Y, so that a toner image is formed on the photoconductor drum 107Y. The toner image is transferred onto the recording paper 102 by the transfer device 112Y at a position (transfer position) at which the photoconductor drum 107Y and the recording paper 102 on the transfer belt 103 come in contact with each other, so that a single-color (Y color) image is formed on the recording paper 102. After the toner image is transferred, unnecessary toner remaining on the surface of the photoconductor drum 107Y is cleaned by the photoreceptor cleaner 111Y for preparation for next image formation.

In this manner, the recording paper 102 on which the single-color (Y color) image is transferred by the image forming unit 101Y is conveyed to the image forming unit 101M by the transfer belt 103. At this position, operation of forming an image of M color is performed in the same manner as the operation of forming the image of Y color as described above, and a toner image of M color formed on the photoconductor drum 107M is transferred onto the recording paper 102 in a superimposed manner. The recording paper 102 is sequentially conveyed to the image forming unit 101C and the image forming unit 101K, where the same image forming operation is sequentially performed and a toner image of C color and a toner image of K color thus formed are transferred onto the recording paper 102, so that a color image is formed on the recording paper 102. Then, the recording paper 102 on which the color toner image is formed by passing through the image forming unit 101K is separated from the transfer belt 103, subjected to a fixing process using the action of heat and pressure by a fixing device 113, and ejected.

Meanwhile, in the tandem-system color copier, it is important to align positions of the colors (perform color shift correction) due to its configuration. Color shift between colors include registration shift in the main-scanning direction (a direction parallel to the rotation axes of the photoconductor drums 107K, 107M, 107C, and 107Y), registration shift in the sub-scanning direction (a direction perpendicular to the rotation axes of the photoconductor drums 107K, 107M, 107C, and 107Y), magnification shift in the main-scanning direction, skew (inclination) shift, and the like. Therefore, the color copier corrects color shift between the colors using color shift correction patterns 114 (see FIG. 2) before actually performing color image forming operation on the recording paper 102.

Figure 2:
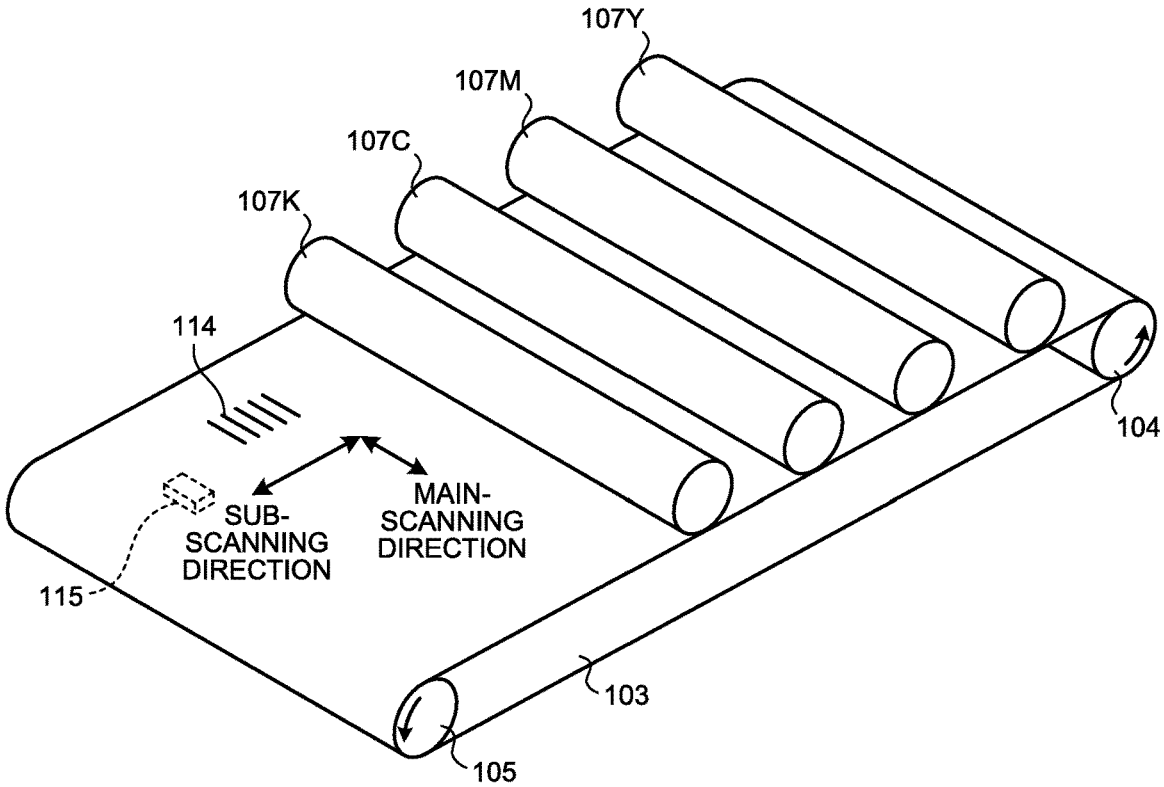
FIG. 2 is a perspective view of a transfer belt on which color shift correction patterns are formed.

FIG. 2 is a perspective view of the transfer belt 103 on which the color shift correction patterns 114 are formed. To correct color shift, the color copier causes the image forming units 101Y, 101M, 101C, and 101K to form the color shift correction patterns 114 of the respective colors on the transfer belt 103, and causes a pattern detection sensor 115 to detect the color shift correction patterns 114. In the example in FIG. 2, the pattern detection sensor 115 is arranged on one side (rear side) of the transfer belt 103 in the main-scanning direction, and the color shift correction patterns 114 are formed on the transfer belt 103 in accordance with the arrangement position of the pattern detection sensor 115. The color shift correction patterns 114 as described above are sequentially detected when the transfer belt 103 moves in a conveying direction indicated in FIG. 2 and passes by the pattern detection sensor 115. When the color shift correction patterns 114 are detected, an arithmetic process for calculating various color shift amounts (an amount of magnification shift in the main-scanning direction, an amount of registration shift in the main-scanning direction, an amount of registration shift in the sub-scanning direction, an amount of skew shift, and an amount of distortion) from detection results, and correction amounts of respective deviated components are calculated from the color shift amounts.

Figure 3:
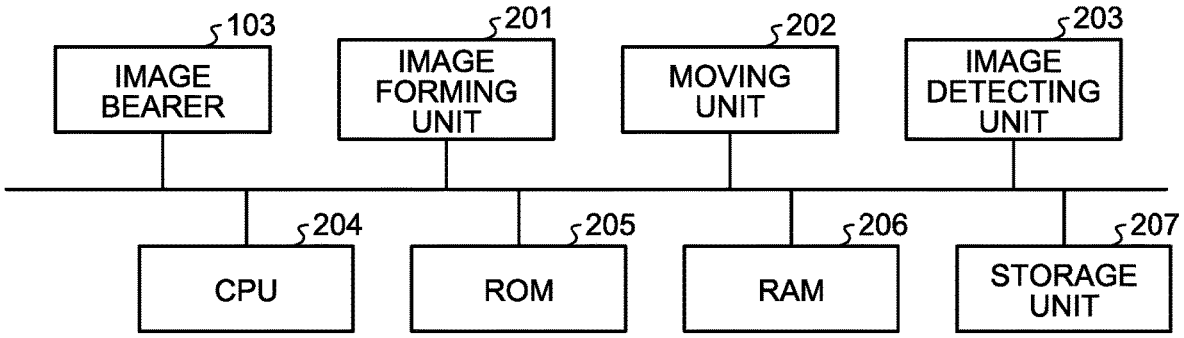
FIG. 3 is a block diagram illustrating a configuration of main components of the image forming apparatus.

FIG. 3 is a block diagram illustrating a configuration of main components of an image forming apparatus 100. The image bearer (the transfer belt) 103, an image forming unit 201, a moving unit 202, an image detecting unit 203, a central processing unit (CPU) 204, a read only memory (ROM) 205, a random access memory (RAM) 206, and a storage unit 207 are included.

The CPU 204 functions as a control unit and controls the entire image forming apparatus. The ROM 205 stores therein a program executed by the CPU 204, and the CPU 204 reads the program from the ROM 205 and executes the program. The RAM 206 is used as a working memory when the CPU 204 performs control. The storage unit 207 is configured with, for example, a hard disk drive (HDD), a ROM, a RAM, or the like.

The image bearer (transfer belt) 103 bears a toner image. The image forming unit 201 sequentially forms groups of pattern images for a plurality of colors in the sub-scanning direction of the image bearer (transfer belt), where each of the groups includes pattern images of a single color at a predetermined interval. The moving unit 202 moves the image bearer (transfer belt) 103 using a driving unit. The image detecting unit 203 detects the pattern images formed on the image bearer (transfer belt) 103. The CPU 204 has a function of a detection processing unit. The detection processing unit recognizes whether an interval between adjacent pattern images of a single color among the detected pattern images corresponds to a set interval, and excludes pattern images for which the interval does not correspond to the set interval. The detection processing unit will be described in detail later.

Figure 4A:
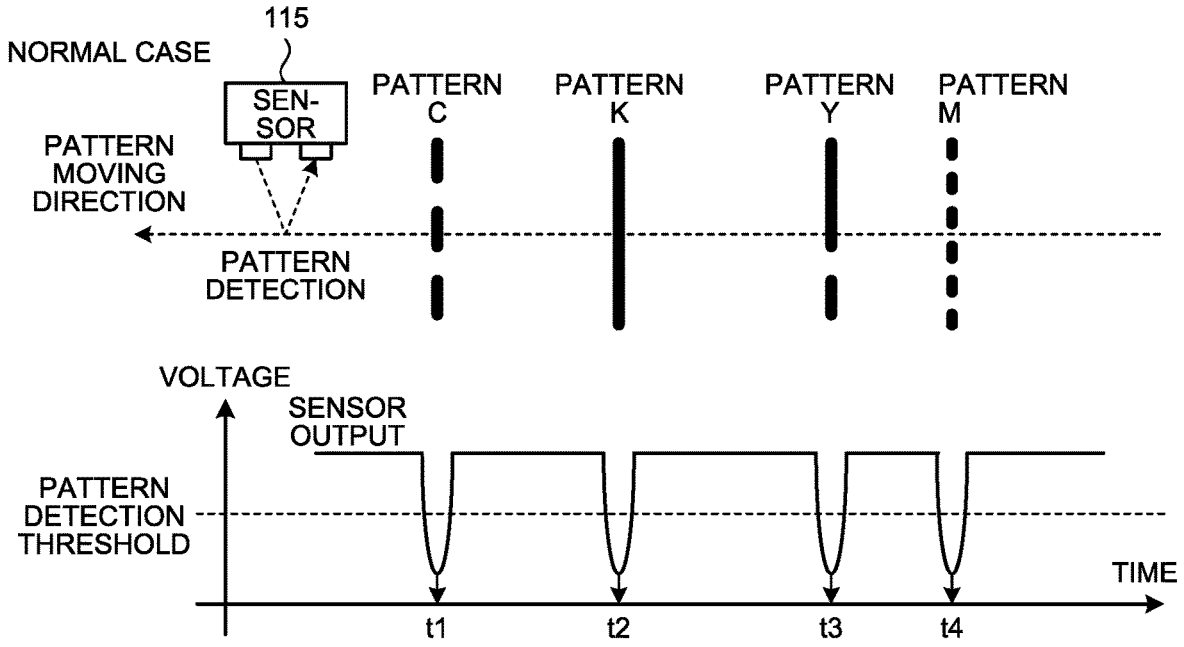
FIG. 4A is a diagram for explaining a normal color shift correction method that is adopted when a defect is not mixed.
Figure 4B:
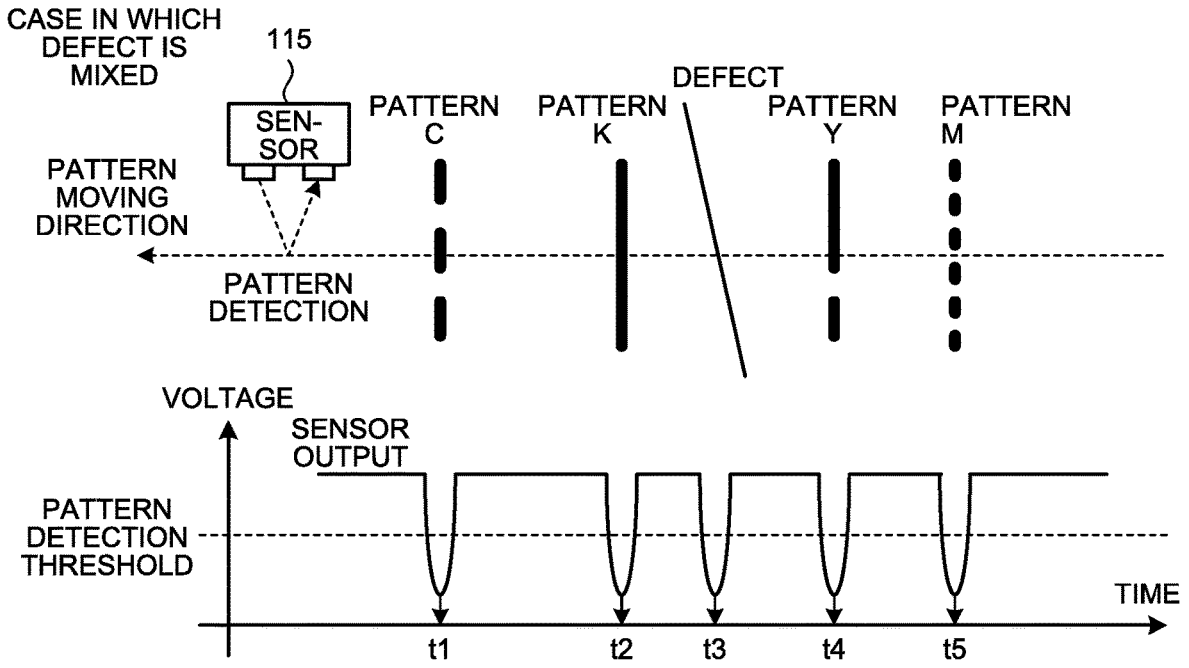
FIG. 4B is a diagram for explaining a normal color shift correction method that is adopted when a defect is mixed.

Next, a normal color shift correction method will be described. FIG. 4A is a diagram for explaining a normal color shift correction method that is adopted when a defect is not mixed, and FIG. 4B is a diagram for explaining a normal color shift correction method that is adopted when a defect is mixed. In the normal color shift correction method illustrated in FIG. 4A, first, the color shift correction patterns 114 of a plurality of colors of C (cyan), K (black), Y (yellow), and M (magenta) are formed on the transfer belt 103. With the rotation of the transfer belt 103, the color shift correction patterns 114 move and sequentially pass by the pattern detection sensor 115. Timings at which analog outputs of the pattern detection sensor 115 fall below and rise above a detection threshold are recorded, and middle timings (t1, t2, t3, and t4 in FIG. 4A) are regarded as timings at which the color shift correction patterns 114 passed by the pattern detection sensor 115. Shifts with respect to a target interval between the color shift correction patterns 114 at the time of image formation are calculated from the timings t1, t2, t3, and t4 at which the color shift correction patterns 114 of the respective colors passed by the pattern detection sensor 115, and the shifts are reflected to image forming timings of the respective colors to thereby correct shift.

In contrast, the normal color shift correction method that is adopted when a defect is mixed as illustrated in FIG. 4B will be described. If a defect is present in a region in which the color shift correction patterns 114 are formed on the transfer belt 103, and when the defect passes by the pattern detection sensor 115, the same output as that of a toner pattern may be obtained in some cases. In this case, five or more color shift correction patterns 114 may be detected although the four color shift correction patterns 114 are expected to be detected. For example, if the number of the color shift correction patterns 114 within a predetermined time is counted, it is possible to detect occurrence of such a situation. However, even when occurrence of such a situation is detected, it is difficult to distinguish the defect from the normal patterns among the five or more patterns. In the general color shift correction, a shift amount is calculated within a single set of color patterns, where the single set includes a single color pattern for each of four different colors, and the calculation is repeated for a several sets. However, if the number of patterns is changed in pattern detection of a certain set, it is impossible to calculate a shift amount in this set.

Figure 5:
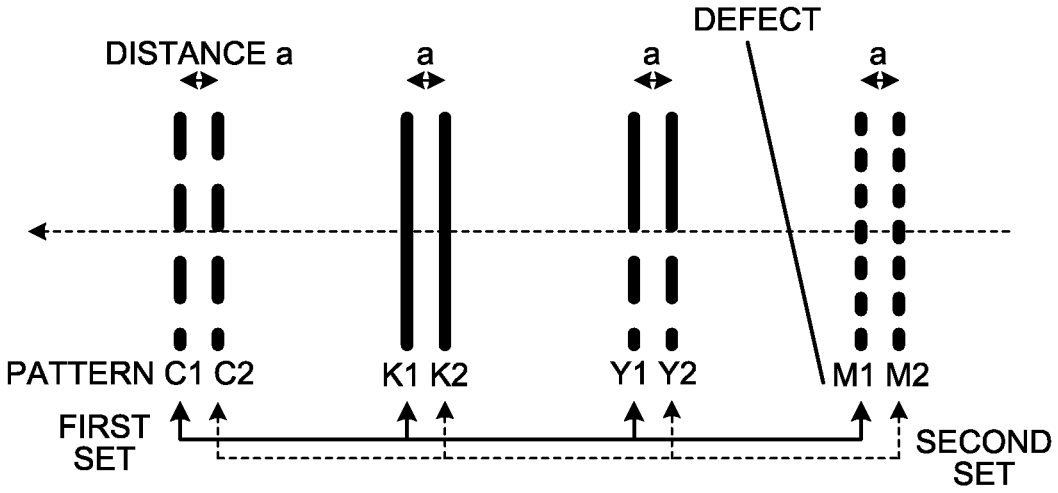
FIG. 5 is a diagram for explaining a first example of color shift correction patterns and pattern detection according to the embodiment.

Therefore, in the present embodiment, to solve the problem as described above, the color shift correction patterns 114 are formed and pattern detection is performed as described below. FIG. 5 is a diagram for explaining a first example of the color shift correction patterns 114 and the pattern detection according to the embodiment, and illustrates a case in which the two color shift correction patterns 114 are formed for each of the colors on the transfer belt 103. In FIG. 5, the plurality of color shift correction patterns 114 for the same color are sequentially formed at a predetermined interval. When the color shift correction patterns 114 are to be formed, image forming timings are adjusted such that even if color shift occurs, a pattern of a different color is not formed between the patterns of the same color.

FIG. 5 illustrates a case in which the two patterns for each of C, K, Y, and M are formed at an interval a. As operation of color shift correction, color shift is detected using, as the color shift correction patterns 114, patterns of C1, K1, Y1, and M1 as one set and patterns of C2, K2, Y2, and M2 as another set. Meanwhile, it may be possible to perform the operation on only any one of the two sets or on both of the two sets. However, when detecting the patterns, "two patterns located at the interval a" are regarded as correct patterns. This uses the fact that the patterns of the same color are not influenced by color shift and are formed at a target interval.

With this operation, for example, even if a single defect is mixed at a position as illustrated in FIG. 5 and is not distinguished from patterns in terms of outputs of the pattern detection sensor 115, the defect can be distinguished except for a limited case in which the defect and the pattern Y2 are formed at the interval a or in which the defect and the pattern M1 are formed at the interval a. Furthermore, even if a defect is mixed between the patterns of the same color, such as the patterns M1 and M2, it is possible to recognize that the patterns M1 and M2 are normal patterns because they are formed at the interval a, and it is also possible to determine that the defect is not a normal pattern because another pattern is not present at the interval a.

Moreover, even when a plurality of defects are present, all of the defects can be distinguished regardless of the number of the defects unless the defect and the color shift correction pattern 114 are formed at the interval a or unless the defects are formed at the interval a.

Figure 6:
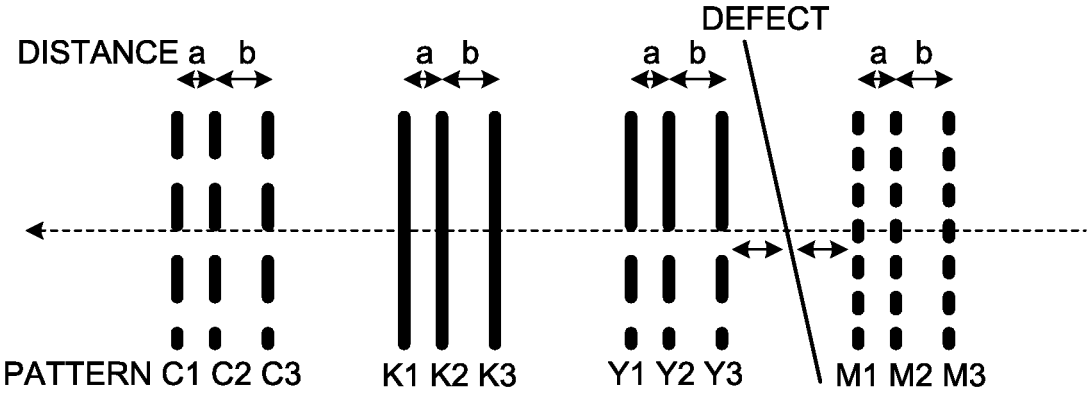
FIG. 6 is a diagram for explaining a second example of the color shift correction patterns and the pattern detection according to the embodiment.

FIG. 6 is a diagram for explaining a second example of the color shift correction patterns 114 and the pattern detection according to the embodiment, and illustrates a case in which the three color shift correction patterns 114 are formed for each of the colors on the transfer belt 103. While the two color patterns are formed for each of the colors in the example illustrated in FIG. 5, it is possible to improve accuracy of defect detection by further increasing the number of patterns. In the example illustrated in FIG. 6, three patterns are formed for each of the colors at intervals of a and b.

As operation of color shift correction, color shift is detected using the patterns of C1, K1, Y1, and M1 as one set, the patterns of C2, K2, Y2, and M2 as another set, and patterns of C3, K3, Y3, and M3 as still another set. Meanwhile, it may be possible to perform the operation on only any one of the three sets, on any two of the three sets, or on all of the three sets. However, when detecting the patterns, "three patterns located at the intervals a and b in this order" are regarded as correct patterns.

With this operation, for example, even if a single defect is mixed at a position as illustrated in FIG. 6 and is not distinguished from patterns in terms of outputs of the pattern detection sensor 115, the defect can be distinguished except for an extremely limited case in which the defect and the pattern Y3 are formed at the interval a and the defect and the pattern M1 are formed at the interval b. Furthermore, similarly to the example illustrated in FIG. 5, even if a defect is mixed between the patterns of the same color, it is possible to distinguish the defect from the patterns without any difficulty.

Even when a plurality of defects are present, all of the defects can be distinguished regardless of the number of the defects unless any defects or any defects and patterns have a relationship such that "three are located at the intervals a and b in this order".

Moreover, in the example illustrated in FIG. 6, a case in which a defect is not distinguished is more limited as compared to the example illustrated in FIG. 5, that is, detect detection is performed with higher accuracy. In this manner, it is possible to improve accuracy of defect detection by increasing the number of patterns of the same color.

Figure 7:
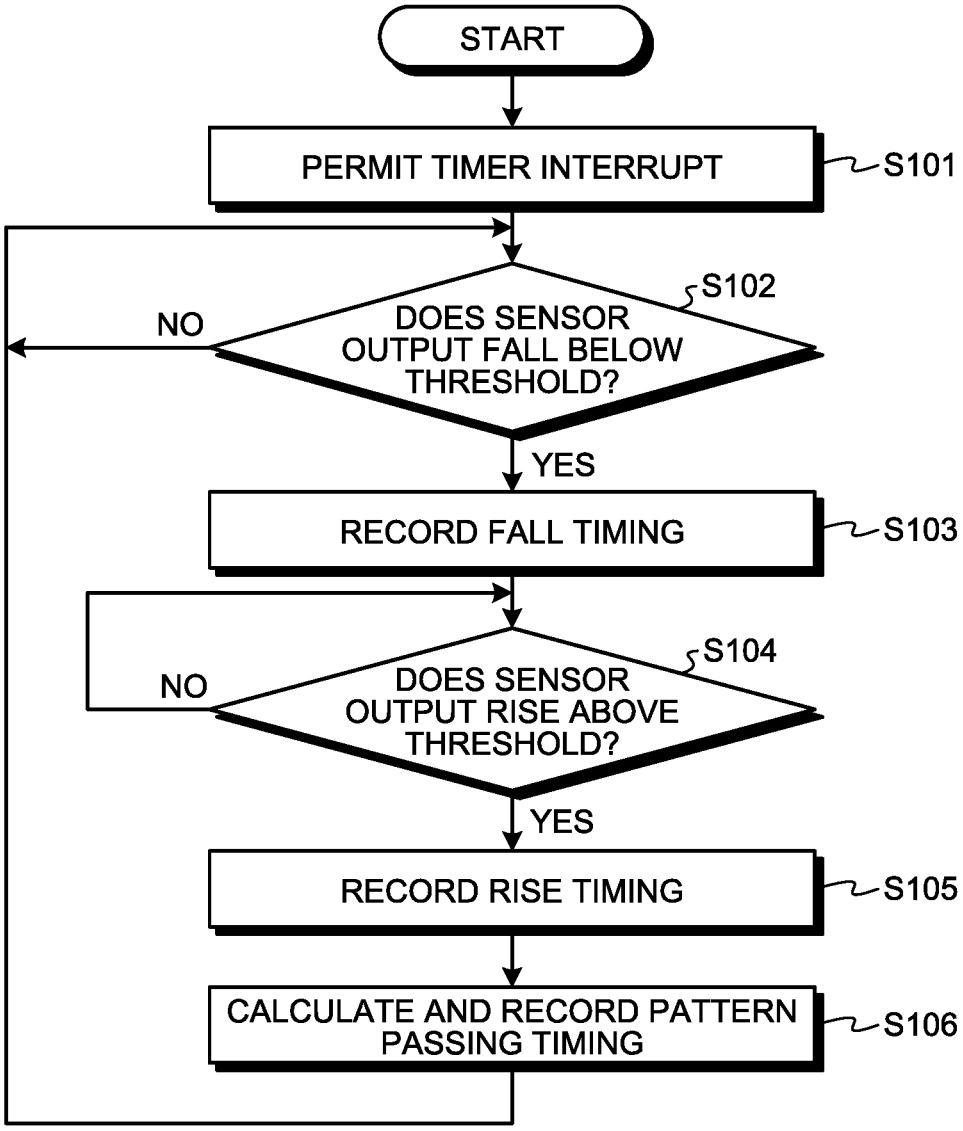
FIG. 7 is a flowchart illustrating an example of pattern detection using the color shift correction patterns.

FIG. 7 is a flowchart illustrating an example of pattern detection using the color shift correction patterns 114. This operation is performed by the control unit (the CPU 204) for each aggregation of a plurality of sets for which the defect detection is performed in a pattern forming region on the transfer belt 103. For example, in the case where the two patterns are formed for the same color as illustrated in FIG. 5, the defect detection is performed for each two sets, such as for the first and the second sets and for the third and the fourth sets, that is, the defect detection is performed for each aggregation of two sets. Meanwhile, a timing at which the control is started is just before the top pattern of the former set passes by the pattern detection sensor 115. This timing can be generally estimated from a distance between the image forming unit 201 and the pattern detection sensor 115 and a speed of the transfer belt 103, and an error can be absorbed by operation performed at Step S102 as described below. Further, a timing at which the control is terminated is just after the last pattern of the latter set. This timing can also be generally estimated, and timer interrupt is caused to occur at this timing. Hereinafter, a case will be described in which the two patterns for the same color are formed at the interval a as illustrated in FIG. 5.

In FIG. 7, first, timer interrupt at the control termination timing as described above is permitted (Step S101). Subsequently, it is determined whether an output of the pattern detection sensor 115 falls below a threshold that is set in advance (Step S102). Here, if it is determined that the output of the pattern detection sensor 115 falls below the threshold that is set in advance (Yes), a timing at which the output of the pattern detection sensor 115 falls below the threshold is recorded (Step S103). In contrast, at Step S102, if the output of the pattern detection sensor 115 does not fall below the threshold that is set in advance (No), wait operation is performed until the output falls below the threshold.

After execution of Step S103, it is further determined whether the output of the pattern detection sensor 115 rises above the threshold that is set in advance (Step S104). Here, if it is determined that the output of the pattern detection sensor 115 rises above the threshold that is set in advance (Yes), a timing at which the output of the pattern detection sensor 115 rises above the threshold is recorded (Step S105). In contrast, at Step S104, if it is determined that the output of the pattern detection sensor 115 does not rise above the threshold that is set in advance (No), wait operation is performed until the output rises above the threshold. Subsequently, a passing timing of the color shift correction pattern 114 is calculated and recorded (Step S106), and the process returns to Step S102, at which the same operation is repeated until timer interrupt occurs. In other words, at Step S106, an average of the timing recorded at Step S102 and the timing recorded at Step S104 is calculated and handled as a pattern passing timing.

The operation from Step S102 to Step S106 as described above is repeated until timer interrupt occurs. If the operation is performed normally, the operation is performed eight times, that is, for the two sets for each of the four colors, and timer interrupt occurs during the ninth wait operation at Step S102. However, the sequence of the operation described herein is adopted when output of the pattern detection sensor 115 is reduced with respect to the color shift correction patterns 114. If a sensor whose output is increased with respect to the color shift correction patterns 114 is used, the operation needs to be performed in sequence of Step S104, Step S105, Step S102, Step S103, and Step S106.

Figure 8:
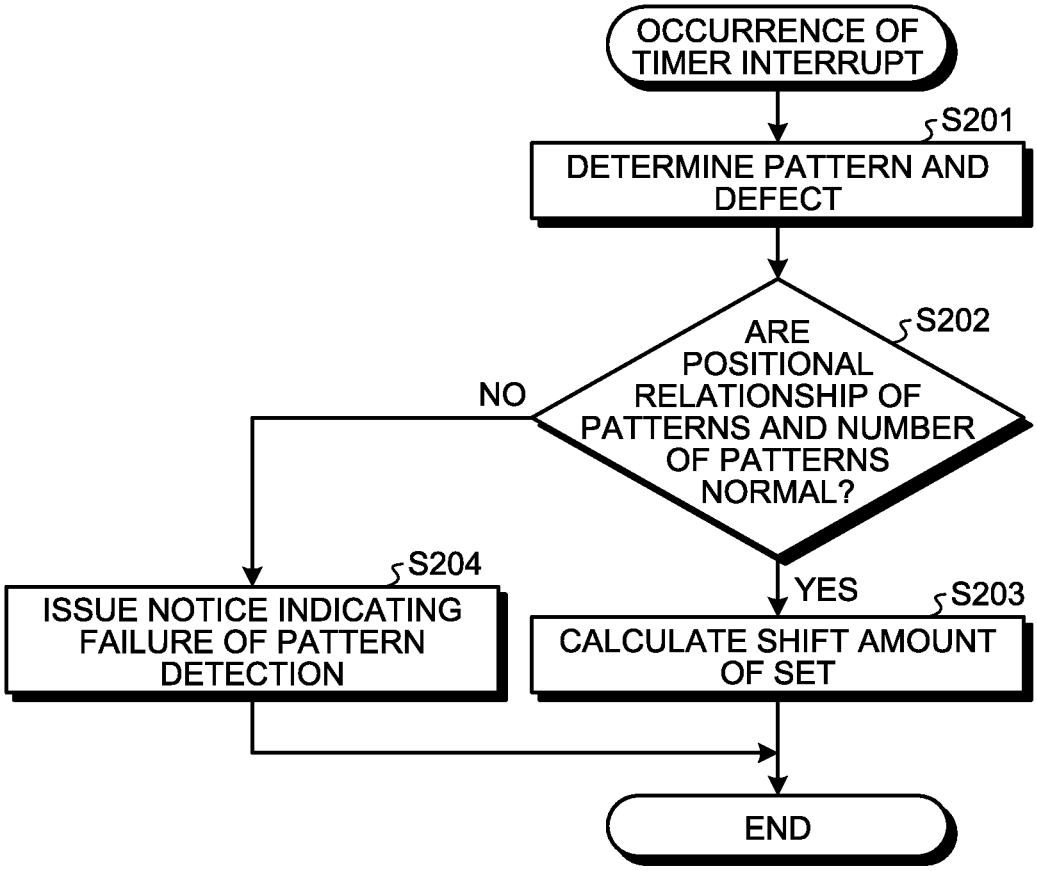
FIG. 8 is a flowchart illustrating timer interrupt operation illustrated in FIG. 7.

FIG. 8 is a flowchart illustrating timer interrupt operation illustrated in FIG. 7. In FIG. 8, first, the color shift correction pattern 114, for which the other color shift correction pattern 114 is not present at a distance corresponding to an expected time interval Ta (which is obtained by dividing the interval a by a belt speed), among the plurality of color shift correction patterns 114 detected at Step S106 is determined as a defect, and excluded (Step S201). Subsequently, it is determined whether a positional relationship of the color shift correction patterns 114 and the number of the color shift correction patterns 114 are normal (Step S202). In other words, it is determined whether the color shift correction patterns 114 determined at Step S201 are four pairs of two patterns that are separated by Ta. If it is determined as YES at Step S202, a color shift amount is calculated for each of the former set and the latter set (Step S203). In contrast, if it is determined as NO at Step S202, a notice indicating that detection of the two sets of the color shift correction patterns 114 adopted as detection targets has failed is issued (Step S204).

Figure 9A:
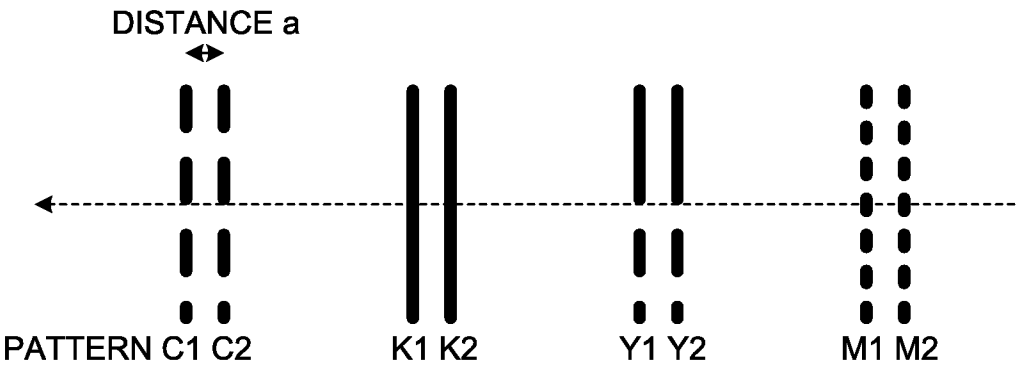
FIG. 9A is a diagram for explaining an example of detection according to the embodiment.

Next, a difference between the present embodiment and a conventional technology (Japanese Laid-open Patent Publication No. 2003-207973) in terms of detection of the color shift correction patterns 114 will be described with reference to FIG. 9A and FIG. 9B. FIG. 9A illustrates an example of detection according to the present embodiment, and FIG. 9B illustrates an example of detection according to the conventional technology.

Figure 9B:
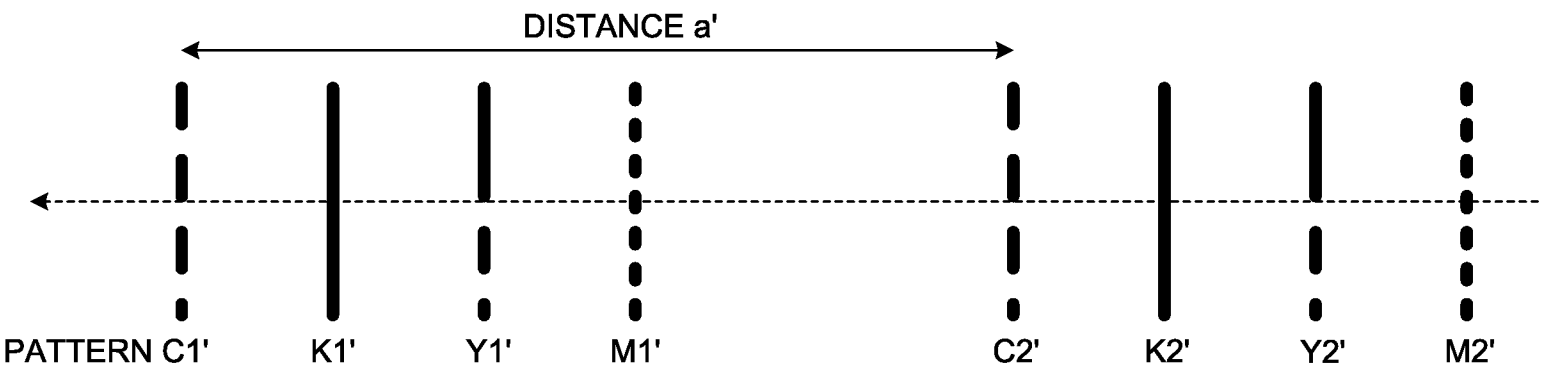
FIG. 9B is a diagram for explaining an example of detection according to the conventional technology.

In both of the examples illustrated in FIG. 9A and FIG. 9B, a defect is detected using a distance between the patterns of the same color based on the fact that color shift does not occur between the patterns of the same color, but the orders of arrangement of the patterns are different as illustrated in FIG. 9A and FIG. 9B. With this arrangement, accuracy of defect detection is improved in the present embodiment as illustrated in FIG. 9A, as compared to the conventional technology as illustrated in FIG. 9B.

In FIG. 9B, similarly to the normal color shift correction, a plurality of sets of color patterns, where each of the sets includes a single color pattern for each of four different colors, are sequentially arranged at predetermined intervals, and a defect is detected based on a distance between patterns of the same color in the adjacent sets (for example, patterns C1' and C2' in FIG. 9B). In this case, three patterns of the other colors are present between the patterns of the same color. In this case, adjacent patterns of different colors in the same set (for example, patterns C1' and K1' in FIG. 9B) need to be formed at a certain interval such that the patterns do not overlap each other even if color shift occurs. Further, the adjacent sets (for example, patterns M1' and C2' in FIG. 9B) need to be formed at a certain interval such that detection for each set is infallibly started during the interval. Due to the two factors as described above, in the order of arrangement of patterns as illustrated in FIG. 9B, an interval a' between the patterns of the same color is inevitably increased. In contrast, in the present invention, other patterns are not present between patterns of the same color, and the two factors as described above need not be taken into account, so that it is possible to reduce the interval a between the patterns of the same color.

In this case, while color shift does not occur between the patterns of the same color, if an interval between the patterns is increased, an error from a target interval that is expected at the time of image formation increases. This is because the speed of the transfer belt 103 is not locally constant due to unevenness of the thickness of the belt and due to eccentricity of a belt driving motor (both of which occur due to manufacturing variation or degradation over time). Even the patterns of the same color may be deviated from the target interval, so that when pattern-defect determination (corresponding to Step S201 in the control flow of FIG. 8) is performed in each of the cases as illustrated in FIG. 9A and FIG. 9B, it is necessary to determine a condition for normal patterns such that "another pattern is present at a position with the interval a (a')±an error" in a precise sense. This error increases as the interval between the patterns of the same color increases as described above. Therefore, the error is extremely small and has little influence on the determination in the case illustrated in FIG. 9A. In contrast, in the case illustrated in FIG. 9B, the error is increased because the interval between the patterns of the same color is increased; therefore, when a defect is present near a pattern for example, the possibility that both of the defect and the pattern may be determined as normal patterns with respect to an adjacent pattern of the same color increases (for example, if a defect is present near the pattern C2', both of the defect and the pattern C2' may be present within a range of a'±the error, so that both of them are determined as normal patterns), and accuracy of pattern-defect determination is reduced as compared to the case illustrated in FIG. 9A.

In the embodiment as described above, YY, MM, CC, and KK are combined as a single set (combination), and patterns that do not match an expected value of an interval between adjacent patterns are determined as defects by using a distance between Y and Y, a distance between M and M, and a distance between C and C in the single set. In this manner, patterns that do not match the expected value of the interval between the adjacent patterns of the same color in the same set are determined as defects among the toner patterns that are recognized by the pattern detection sensor 115, and the determined patterns are excluded; therefore, it is possible to more reliably detect color shift. In other words, even a defect that may be recognized as a toner pattern by the pattern detection sensor 115 is distinguished from toner patterns, so that it is possible to more reliably detect color shift.

Program

A program executed in the present embodiment is provided by being incorporated in the ROM 205 or the like in advance. Further, the above-described program may be provided by being recorded in a computer readable recording medium, such as a compact disc-ROM (CD-ROM), a flexible disk (FD), a compact disc-recordable (CD-R), or a digital versatile disk (DVD), in a computer-installable or computer-executable file format.

Furthermore, the program executed in the present embodiment may be stored in a computer connected to a network, such as the Internet, and provided by being downloaded via the network. Moreover, the program executed in the present embodiment may be provided or distributed via a network, such as the Internet.

The program executed in the present embodiment has a module structure including the units as described above. As actual hardware, the CPU 204 reads the program from the ROM 205 and executes the program, so that each of the units as described above is loaded on a main storage device and each of the units is generated on the main storage device.

According to an embodiment, it is possible to improve accuracy of detection of a color shift correction toner pattern formed on an image bearer.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An image forming apparatus comprising:

an image bearer configured to bear a toner image;

an image forming unit configured to sequentially form groups of pattern images for a plurality of colors in a sub-scanning direction of the image bearer, each of the groups including pattern images of a same color, the pattern images of the same color formed at a predetermined interval, and each of the groups corresponds with a different color;

a toner image detecting unit configured to detect the pattern images formed on the image bearer; and a detection processing unit configured to recognize whether an interval between adjacent pattern images of the same color corresponds to a set interval, and to exclude an image for which the interval does not correspond to the set interval among the detected pattern images.

2. The image forming apparatus according to claim 1, wherein a first group includes a plurality of first patterns adjacent to each other and formed using a first color, a second group includes a plurality of second patterns adjacent to each other and formed using a second color, and the first group and the second group are formed at a first interval.

3. The image forming apparatus according to claim 2, wherein the plurality of first patterns and the plurality of second patterns are each formed at a second interval, and the second interval is smaller than the first interval.

4. The image forming apparatus according to claim 2, wherein the toner image further has a third color and a fourth color that are different from the first color and the second color, and the third color and the fourth color are different from each other.

5. The image forming apparatus according to claim 1, wherein the detection processing unit is configured to, when another pattern image is not present at a position that is not separated by the predetermined interval at a time of detection from an image among the pattern images having been detected for each of the groups by the toner image detecting unit, determine the image as a defect on the image bearer, and to exclude the defect from color shift correction calculation.

6. A pattern detection method implemented by an image forming apparatus including:

an image bearer configured to bear a toner image;

an image forming unit configured to sequentially form groups of pattern images for a plurality of colors in a sub-scanning direction of the image bearer, each of the groups including pattern images of a same color, the pattern images of the same color formed at a predetermined interval, and each of the groups corresponds with a different color; and a toner image detecting unit configured to detect the pattern images formed on the image bearer, the pattern detection method comprising:

recognizing whether an interval between adjacent pattern images of the same color corresponds to a set interval; and excluding an image for which the interval does not correspond to the set interval among the detected pattern images.

* * * * *